United States Patent [19]

Egashira et al.

[11] Patent Number: 4,963,522

[45] Date of Patent: Oct. 16, 1990

[54] HEAT TRANSFER SHEET

[75] Inventors: Noritaka Egashira; Naoto Satake, both of Shinjuku, Japan

[73] Assignee: Dai Nippon Insatsu Kabushiki Kaisha, Japan

[21] Appl. No.: 274,952

[22] Filed: Nov. 18, 1988

[30] Foreign Application Priority Data

Jul. 26, 1988 [JP] Japan ..... 63-185800
Sep. 29, 1988 [JP] Japan ..... 63-245688
Oct. 17, 1988 [JP] Japan ..... 63-261262

[51] Int. Cl.[5] ..... B41M 5/035; B41M 5/26

[52] U.S. Cl. ..... 503/227; 8/471; 428/195; 428/913; 428/914

[58] Field of Search ..... 8/471; 428/195, 212, 428/484, 488.1, 488.4, 913, 914; 503/227

[56] References Cited

FOREIGN PATENT DOCUMENTS 59308 9/1982 European Pat. Off. ..... 503/227
138483 4/1985 European Pat. Off. ..... 503/227

*Primary Examiner*—Pamela R. Schwartz
*Attorney, Agent, or Firm*—Arnold, White & Durkee

[57] ABSTRACT

A heat transfer sheet for an electrothermal transfer system including a dye layer containing a heat migratable dye on one surface of a substrate sheet and a resistance layer which generates heat by electrical current flow on the other surface of the substrate sheet. The heat transfer sheet is characterized in that a slip property imparting agent for lowering the frictional resistance between the resistance layer and electrode head during transfer is contained in the resistance layer.

6 Claims, 1 Drawing Sheet

HEAT TRANSFER SHEET

BACKGROUND OF THE INVENTION

This invention relates to a heat transfer sheet, more particularly to a heat transfer sheet to be utilized for electrothermal transfer systems.

As a heat transfer sheet to be utilized for electrothermal transfer systems which generate heat by electrical current from an electrode head to effect transfer with the heat, there has been heretofore employed a constitution comprising a resistance layer which generates heat by current flow from the electrode head provided on one surface of the substrate and a dye layer containing a heat-migratable dye such as a sublimable dye on the other surface side of the substrate.

However, in this kind of heat transfer sheet of the prior art, when long-run transfer is performed, there have been the drawbacks that deterioration of the head is liable to occur by friction between the electrode head and the resistance layer, and also that defective transfer, defective running, etc., are liable to occur due to the friction resistance of the head and the resistance layer.

The present invention has been accomplished in view of the above points, and its object is to provide a heat transfer sheet which has eliminated the various problems caused by friction and heat generated between the electrode head and the resistance layer.

SUMMARY OF THE INVENTION

The heat transfer sheet of the present invention is a heat transfer sheet for electrothermal transfer systems and comprises a dye layer containing a heat-migratable dye on one surface of a substrate sheet and a resistance layer which generates heat by electrical current on the other surface of said substrate sheet. The sheet is characterized in that an agent for imparting a slip property to lower the frictional resistance between the resistance layer and electrode head during transfer is contained in said resistance layer.

In a preferred embodiment of the present invention, the above slip property imparting agent comprises an organic lubricant and/or a surfactant.

In another preferred embodiment of the present invention, the above resistance layer comprises a heat-resistant resin and a electroconductive substance as the main components.

Furthermore, in another preferred embodiment of the present invention, the above resistance layer comprises (a) a low resistance layer having a surface resistance value of 100 to 1000 Ω/□ and (b) a high resistance layer having a surface resistance value of 1 to 20 KΩ/□ laminated in this order on the above substrate sheet.

DETAILED DESCRIPTION OF THE INVENTION

Figure 1:
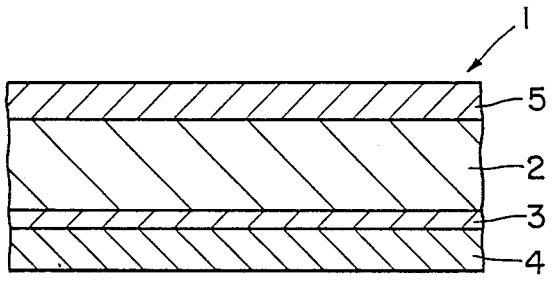
FIG. 1 and FIG. 2 are each sectional views of a heat transfer sheet according to an embodiment of the present invention.

The present invention is described below by referring to the drawings.

FIG. 1 shows an embodiment of the heat transfer sheet 1 of the present invention. The heat transfer sheet 1 has a dye layer 4 provided through an intermediary adhesive 3 on one surface of a substrate sheet 2, and also a resistance layer 5 provided on the other side of the substrate sheet 2.

As the above substrate sheet 2, one having rigidity and heat-resistance to some extent is used. As the material for the substrate sheet 2, polyester, polystyrene, polypropylene, polysulfone, aromatic polyamide, polycarbonate, polyvinyl alcohol, cellophane, etc. may be included, with polyester being the preferred material. This substrate sheet 2 should preferably have a thickness of 1.5 to 25 μm, particularly about 3 to 10 μm. The adhesive layer 3 provided between the substrate sheet 2 and the dye layer 4 is optionally provided, and need not be necessarily provided. As the adhesive layer 3, for example, there may be employed homopolymers of unsaturated carboxylic acids such as acrylic acid, methacrylic acid, maleic acid, etc., copolymers of these monomers with other vinyl monomers, such as styrene-maleic acid copolymer, styrene-(meth)acrylic acid copolymer, (meth)acrylic acid-(meth)acrylic acid ester copolymer, etc., or vinyl alcohol type resins such as polyvinyl alcohol, partially saponified polyvinyl acetate, vinyl alcohol-ethylene-(meth)acrylic acid copolymer, etc., further resins such as polyester, modified polyamide, etc. modified to insoluble or partially soluble in solvents having the resin for formation of the dye layer during formation of the dye layer 4. The adhesive layer 3 should preferably have a thickness of about 0.1 to 0.5 μm.

The dye layer 4 is constituted of a resin containing a dye migratable by heat such as sublimable dyes, etc., and examples of the resin to be used for constitution of the dye layer 4 may include cellulosic resins such as ethyl cellulose, hydroxyethyl cellulose, ethylhydroxy cellulose, hydroxypropyl cellulose, methyl cellulose, cellulose acetate, cellulose acetate butyrate, etc., vinyl resins such as polyvinyl alcohol, polyvinyl acetate, polyvinyl butyral, polyvinyl acetal, polyvinyl pyrrolidone, polyacrylamide, etc. As the dye to be contained in the dye layer 4, all of the dyes known in the art to be employed in a heat transfer sheet, such as sublimable disperse dyes, sublimable oil-soluble dyes and sublimable basic dyes, etc. can be effectively used for the present invention, and there are no particular limitations. For example, some preferable dyes may include red dyes such as Sumiplast Red 301, PTR-51, Seriton Red SF-7864, Sumiplast Red B, Mihara Oil Red, etc.; yellow dyes such as PTY-51, ICI-C-5G, Miketone Polyester Yellow YL, etc.; and blue dyes such as Kayaset Blue A-2R, Diaresin Blue N PTB 76, PTV-54, etc. The ratio of these resins and the above resin constituting the dye layer 4 may be preferably 10 to 60 parts by weight of the dye per 100 parts by weight of the resin. The dye layer should preferably have a thickness of about 0.1 to 2 μ m.

The resistance layer is constituted of a resin having excellent heat resistance such as polyvinyl butyral, polyester, polyester butyral, urethane type polyester, sulfone type polyester, etc. containing an electroconductive substance such as carbon, metal powder, etc. added therein. As the carbon, for example, Furnace Black, Acetylene Black, Ketchen Black, Channel Black, Thermal Black, etc. can be used, and as the metal powder, for example, metal powder of nickel, copper, iron, silver, tin oxide, indium oxide, zinc oxide, antimony oxide, etc. can be used. The amount of the carbon or metal powder added may be preferably such that the resistance value of the resistance layer 5 may become about 100 to 20 KΩ/□. The resistance layer 5 should preferably have a thickness of about 2 to 5 μm.

The heat transfer sheet 1 of the present invention contains a slip property imparting agent in the above resistance layer 5. As the slip property imparting agent, a nonionic surfactant and/or a lubricant is used.

Examples of nonionic surfactant may include alkyl allyl ether type such as polyoxyethylene nonylphenyl ether, polyoxyethylene octylphenyl ether, etc.; alkyl ether type such as polyoxyethylene alkyl ether, polyoxyethylene lauryl ether, polyoxyethylene oleyl ether, polyoxyethylene tridecyl ether, polyoxyethylene alkyl ether, polyoxyethylene cetyl ether, polyoxyethylene stearyl ether, etc.; alkyl ester type such as polyoxyethylene laurate, polyoxyethylene oleate, polyoxyethylene stearate, etc.; alkylamine type such as polyoxyethylene laurylamine; sorbitane derivative ester type such as sorbitane laurate, sorbitane palmitate, sorbitane stearate, sorbitane oleate, sorbitane fatty acid ester, etc.; sorbitane derivative complex type such as polyoxyethylene sorbitane laurate, polyoxyethylene sorbitane palmitate, polyoxyethylene sorbitane stearate, polyoxyethylene sorbitane oleate, etc. These nonionic surfactants may be added in amounts preferably of 10 to 30 parts by weight per 100 parts by weight of the resin constituting the resistance layer 5.

As the lubricant, an organic lubricant can be preferably used. For example, there may be included hydrocarbon lubricants such as fluid paraffin, natural paraffin, polyethylene wax, chlorinated hydrocarbon, etc.; fatty acid lubricants such as lauric acid, myristic acid, palmitic acid, stearic acid, etc.; fatty acid amide lubricants such as stearic amide, stearic oleic amide, oleic amide, erucic amide, ethylenebisstearic amide, etc.; ester lubricants such as butyl stearate, cetyl palmitate, stearic monoglyceride, etc.; silicone lubricants such as amino-modified silicone oil, epoxy-modified silicone oil, polyether-modified silicone oil, olefin-modified silicone oil, fluorine-modified silicone oil, alcohol-modified silicone oil and higher fatty acid-modified silicone oil, etc. These lubricants may be preferably added in amounts of 10 to 30 parts by weight per 100 parts by weight of the resin constituting the resistance layer 5.

According to the knowledge of the present inventors, the organic lubricant as described above, tends to become higher in concentration distribution of the lubricant contained at the surface of the resistance layer (namely, the surface on the side with which the electrode head comes into contact), and therefore the preferable effect of imparting the slip property is further increased. In contrast, in the case of an inorganic lubricant, the concentration distribution in the thickness direction tends to become substantially uniform.

The resistance layer 5 in the present invention is formed of a heat-resistant resin and an electroconductive substance as the main components as described above. The above heat-resistant resin refers to a resin material such that the resistance layer 5 becomes finally a resin layer having excellent heat resistance, for example, a resin material of which the resin itself has heat resistance, or of which coated film can be cured by crosslinking curing, etc. to reveal heat resistance. As the heat-resistant resin, for example, phenol-formaldehyde resin, furan resin, xylene-formaldehyde resin, ketone-formaldehyde resin, urea resin, melamine resin, aniline resin, alkyd resin, unsaturated polyester resin, acrolein resin, etc. may be employed, and further, a crosslinking curable resin such as crosslinkable resin of a polyol resin and an isocyanate resin, etc. may be employed.

In the heat transfer sheet of an electrothermal transfer system of this kind of the prior art, for example, in the case of the type wherein the dye is melted and migrated by heating, the energy for transfer (namely the amount of heat generated with the resistance layer for migration of the dye) is low and therefore no great problem occurs. However, in the case of a dye layer of the type wherein the dye is migrated through sublimation by heating, the energy for transfer is high and the heat generation temperature with the resistance layer becomes higher, and therefore the resistance layer is fused thermally with the electrode head, whereby there are involved inconveniences such as poor running during printing, or that good transfer cannot be effected.

In the present invention, by the use of the resin having excellent heat resistance as described above, even when transfer is effected with high energy, there can be provided a heat transfer sheet which will not cause any thermal fusion between the resistance layer and the electrode head, and yet can still effect good transfer stably.

Figure 2:
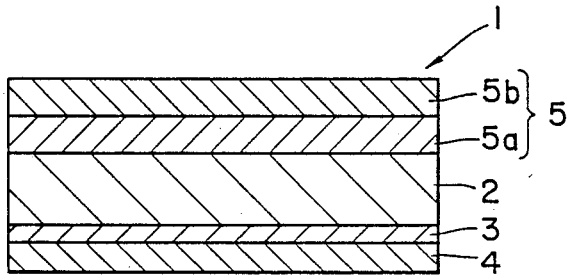

In the embodiment shown in FIG. 2, the heat transfer sheet 1 is provided through the intermediary adhesive layer 3 on one side surface of the substrate sheet 2, and on the surface on the opposite side is laminated the resistance layer 5 comprising a low resistance layer **5*a* and a high resistance layer 5*b***.

More specifically, the resistance layer 5 comprising the low resistance layer **5*a* and the high resistance layer 5*b* is arranged, as shown in the Figure, so that the high resistance layer 5*b* may be positioned on the surface side. The low resistance layer 5*a* has a resistance value of 100 Ω/□ to 1,000 Ω/□, further preferably 100 to 500 Ω/□, while the high resistance layer 5*b* has a resistance value of 1 KΩ/□, further preferably 1 to 10 KΩ/□. By having such resistance values, only little current passes through the high resistance layer positioned on the surface side, with the result that heat generation becomes smaller on the high resistance layer surface, whereby there is no inconvenience such as fusion of the electrode heads, etc. and yet good sublimation transfer can be effected. Accordingly, the difference in resistance value between the high resistance layer and th low resistance layer is required to be large to some extent, with the difference in resistance value between the high resistance layer 5*b* and the low resistance layer 5*a*** being preferably 900 Ω/□ or more, more preferably 500 Ω/□ or more.

As the material for the respective resistance layers, the following materials may be employed. That is, as the material for the low resistance layer, a synthetic resin having excellent heat resistance such as vinyl butyral, polyvinyl butyral, polyester, polyester butyral, urethane type polyester, sulfone type polyester, etc. having an electroconductive substance such as carbon, metal powder, etc. added therein, or a substrate sheet having a metal such as Al, etc. vapor deposited thereon, and other materials which can have the above resistance value may be available.

On the other hand, as the material for the high resistance layer, a combination of the above synthetic resin with carbon can be similarly used.

In addition to the above embodiments, as another embodiment, an embodiment using the substrate sheet itself as the low resistance layer is also possible. In this case, since one layer of low resistance layer is reduced, simplification of the preparation steps and cost reductions can be effected.

In the above embodiment, which has a laminate comprising a low resistance layer and a high resistance layer having specific resistance values, the amount of heat necessary for printing can be obtained and also heat generation at the surface portion of the heat transfer sheet can be suppressed, and consequently, there occurs no inconvenience such as fusion between the electrode head and the heat transfer sheet, etc. and yet the transfer of good dye layer can be effected.

The present invention is described in more detail by referring to specific Examples.

EXAMPLES 1–2, REFERENCE EXAMPLE 1

On one surface of a substrate sheet comprising a polyethyleneterephthalate sheet with a thickness of 6 μm was applied a composition containing 20 parts by weight of Kayaset Blue A-2R of a sublimable dye per 100 parts by weight of a polyvinyl acetal resin to a coated amount on drying of 1 g/m$^2$, followed by drying to form a dye layer. Next, on the surface opposite to the surface on which the dye layer was provided, a composition formation of resistance layer shown in Table 1 (the formulated amount shows parts by weight) was applied to a coated amount on drying of 3 g/m$^2$, followed by drying to form a resistance layer, thus providing a heat transfer sheet. By use of each heat transfer sheet obtained, transfer was effected under the transfer conditions shown below by means of an electrothermal transfer device having heads using copper wires of about 50 μm in diameter applied at the tip end with nickel plating juxtaposed at intervals of a 8 wires/mm as the electrothermal head which is the signal electrode, while using heads of flat plates of copper applied with the same treatment in parallel to the above juxtaposed direction with a distance of about 0.3 mm therefrom as the earth eIeolrode. TabIe 2 shows the quality of the running stability and the transferred state.

Transfer conditions

Pulse width: 1 ms

Recording period: 2.0 ms

Recording energy: 3.0 J/cm$^2$

TABLE 1

| | Example 1 | Example 2 | Reference Example 1 |
|---|---|---|---|
| Resin*1 | 100 | 100 | 100 |
| Carbon black | 20 | 20 | 20 |
| Surfactant*2 | 10 | — | — |
| Lubricant*3 | — | 10 | — |

*1Polyester type resin (produced by Toyobo: Vyron 200)
*2Polyoxyethylene oleyl ether (nonionic surfactant, produced by Nippon Yushi K.K., Japan: Nonion E-206)
*3Dimethylsiloxane (produced by Shinetsu Kagaku Kogyo K.K., Japan: KF-96)

TABLE 2

| | Running stability*4 | Transferred state*5 |
|---|---|---|
| Example 1 | Good | Good |
| Example 2 | Good | Good |

TABLE 2-continued

| | Running stability*4 | Transferred state*5 |
|---|---|---|
| Reference Example 1 | Bad | Bad |

*4Running stability is determined by the following standards when transfer test is conducted by longrun running with heat transfer sheet superposed on an image-receiving sheet: running of heat transfer sheet and image-receiving sheet at the same speed . . . Good; and running of heat transfer sheet and image-receiving sheet at different speeds . . . Bad.
*5Transferred state is determined by the following standards by observation of the transferred image: transferred image without irregularity Good; and transferred image with irregularity . . . Bad.

As is apparent from the above Examples, the heat transfer sheet of the present invention, which contains a slip property imparting agent comprising a non-ionic surfactant and/or a lubricant in the resistance layer, can be lowered in frictional resistance between the electrode head and the resistance layer when compared with the heat transfer sheet of this kind of the prior art, and consequently the running stability of the heat transfer sheet in the transfer device can be enhanced, and there is also the effect of improved transferability. Also, the heat transfer sheet of the present invention owing to low resistance between the electrode head and the resistance layer, has no fear of deteriorating the electrode head, thus having the effect of elongating the life of the head, etc.

EXAMPLES 3–4, REFERENCE EXAMPLE 2

By use of a polyethyleneterephthalate sheet with a thickness of 6 μm as the substrate sheet, an adhesive layer with a thickness of 0.3 μm was formed on its one surface and a dye layer with a thickness of 1 μm containing a sublimable dye was formed thereon. Next, on the other surface of the substrate sheet was formed each of the respective resin copositions for formation of resistance layer having the following compositions to form each heat transfer sheet.

| Resin composition for formation of resistance layer | |
|---|---|
| (Example 3) | |
| Polyester resin | 100 parts |
| Aromatic isocyanate | 10 parts |
| Carbon | 30 parts |
| **Resin composition for formation of resistance layer** | |
| (Example 4) | |
| Polyester resin | 100 parts |
| Aliphatic isocyanate | 15 parts |
| Carbon | 30 parts |
| **Resin composition for formation of resistance layer** | |
| (Reference Example 2) | |
| Polyester resin | 100 parts |
| Carbon | 30 parts |

The above "parts" indicate parts by weight, and the resistance values of the resistance layers in the respective heat transfer sheets were:

Example 3 . . . 1.2Ω, Example 4 . . . 1.0Ω, and Reference Example 2 . . . 1.1Ω.

By use of each heat transfer sheet, heat transfer was performed under the conditions shown below.

Transfer conditions

Pulse width: 1 ms

Recording period: 2.0 ms

Recording energy: 3.0 J/cm$^2$

As the result, except for Reference Example 2, in all the Examples, there was no thermal fusion generated between the electrode head and the resistance layer, and also the printed image formed by transfer was found to be good. In Reference Example 2, due to thermal fusion, poor running occurred and the transfer film was broken.

As is apparent from the above Examples, in the heat transfer sheet of the present invention, of which the resistance layer is constituted by use of at least a heat resistance, thermal fusion between the electrode head and the resistance layer (sheet) by high heat generation of the resistance layer during current flow will occur without difficulty even when transfer requiring high energy is effected, and consequently there is no fear of poor sheet running occurring during printing, thereby allowing good and stable transfer.

EXAMPLES 5–6, REFERENCE EXAMPLE 3

By use of a polyethyleneterephthalate with a thickness of 6 μm as the substrate sheet, an adhesive layer with a thickness of 0.3 μm was formed on its one surface, and a dye layer with a thickness of 1 μm was formed thereon. Next, on the other surface of the substrate sheet were successively formed a low resistance layer and a high resistance layer with the material, thickness and resistance values shown in Table 3 to form a heat transfer sheet.

By use of each heat transfer sheet, heat transfer was performed under the conditions shown below, and the state of the electrode head, the state of the heat transfer sheet and the transferred state are shown together in Table 1.

Transfer conditions

Pulse width: 1 ms

Recording period: 2.0 ms

Recording energy: 3.0 J/cm$^2$

As is apparent from the above Examples, the heat transfer sheet of the present invention, which has a resistance layer comprising a laminate of a low resistance layer and a high resistance layer, can give a heat generation amount necessary for printing and also suppress heat generation at the heat transfer sheet surface, with the result that no inconvenience such as fusion of the heat and the heat transfer sheet, etc. will occur, and yet good transfer of the dye layer can be effected.

We claim:

1. A heat transfer sheet for an electrothermal transfer system, comprising:

a substrate sheet;

a dye layer formed on one surface of said substrate sheet, said dye layer comprising a sublimable dye and a binder; and a resistance layer which is capable of generating heat by electrical current formed on the other surface of said substrate sheet, said resistance layer comprising a heat-resistant resin, an electroconductive substance and a slip property imparting agent for lowering the frictional resistance between the resistance layer and an electrode head during electrothermal transfer.

2. A heat transfer sheet according to claim 1, wherein said slip property imparting agent comprises at least one material selected from the group consisting of organic lubricants and surfactants.

3. A heat transfer sheet according to claim 2, wherein said surfactant comprises a nonionic surfactant.

4. A heat transfer sheet according to claim 1, wherein said heat-resistant resin comprises a crosslinking curable resin.

5. A heat transfer sheet according to claim 1, wherein said resistance layer comprises a low resistance layer having a surface resistance value of 100 to 1000 Ω/□ and (b) a high resistance layer having a surface resistance value of 1 to 20 KΩ/□ laminated in this order on said substrate sheet.

6. A heat transfer sheet according to claim 5, wherein the difference in surface resistance value between said low resistance layer and said high resistance layer is 900 Ω/□ or more.

* * * * *

TABLE 3

| | Low resistance layer | | | High resistance layer | | | Printing | |
|---|---|---|---|---|---|---|---|---|
| | Material | Thickness | Resistance value (Ω/□) | Material | Thickness | Resistance value (Ω/□) | State of sheet | Transferred state |
| Example 5 | Polyvinyl butyral | 5 (μm) | 600 | Polyester | 3 (μm) | 4 (K) | | |
| Example 6 | Polyvinyl butyral | 5 (μm) | 600 | Polyvinyl butyral | 2 (μm) | 10 (K) | | |
| Reference Example 3 | * | * | * | Polyvinyl butyral | 6 (μm) | 300 | Fused | Bad |